US011308866B2

(12) United States Patent
Tian et al.

(10) Patent No.: US 11,308,866 B2
(45) Date of Patent: Apr. 19, 2022

(54) OLED PIXEL COMPENSATION CIRCUIT AND OLED PIXEL COMPENSATION METHOD

(71) Applicant: SHENZHEN CHINA STAR OPTOELECTRONICS SEMICONDUCTOR DISPLAY TECHNOLOGY CO., LTD., Shenzhen (CN)

(72) Inventors: Fan Tian, Shenzhen (CN); Zhenling Wang, Shenzhen (CN)

( * ) Notice: Subject to any disclaimer, the term of this patent is extended or adjusted under 35 U.S.C. 154(b) by 280 days.

(21) Appl. No.: 16/618,126

(22) PCT Filed: Nov. 6, 2019

(86) PCT No.: PCT/CN2019/115937
§ 371 (c)(1),
(2) Date: Nov. 28, 2019

(87) PCT Pub. No.: WO2021/046999
PCT Pub. Date: Mar. 18, 2021

(65) Prior Publication Data

US 2021/0407388 A1 Dec. 30, 2021

(30) Foreign Application Priority Data

Sep. 12, 2019 (CN) ..... 201910867287.0

(51) Int. Cl.
*G09G 3/3208* (2016.01)

(52) U.S. Cl.
CPC ... *G09G 3/3208* (2013.01); *G09G 2300/0842* (2013.01); *G09G 2310/08* (2013.01); *G09G 2320/0233* (2013.01)

(58) Field of Classification Search
CPC .... G09G 3/32–3291; G09G 2300/0842–0866; G09G 2310/08; G09G 2320/0233
USPC ..... 345/694
See application file for complete search history.

(56) References Cited

U.S. PATENT DOCUMENTS

| | | | | |
|---|---|---|---|---|
| 9,853,068 | B2 | 12/2017 | Miyake | |
| 2014/0168194 | A1* | 6/2014 | Kong | H01L 29/78645 345/212 |
| 2015/0187276 | A1* | 7/2015 | Shim | G09G 3/3233 345/77 |
| 2018/0102397 | A1 | 4/2018 | Nie | |

FOREIGN PATENT DOCUMENTS

| | | | |
|---|---|---|---|
| CN | 105741781 | A | 7/2016 |
| CN | 106504707 | A | 3/2017 |
| CN | 109712565 | A | 5/2019 |

* cited by examiner

*Primary Examiner* — Amare Mengistu
*Assistant Examiner* — Gloryvid Figueroa-Gibson

(57) ABSTRACT

The present disclosure proposes an OLED pixel compensation circuit and an OLED pixel compensation method. The OLED pixel compensation circuit includes an OLED, a driving transistor, a first TFT, a second TFT, a third TFT, a fourth TFT, a first capacitor, and a second capacitor. The present disclosure adopts 5T2C structure and the driving transistor is a double gate TFT to compensate the variance of the threshold voltage such that the luminance evenness is raised and the lifetime of the product is extended.

8 Claims, 7 Drawing Sheets

OLED PIXEL COMPENSATION CIRCUIT AND OLED PIXEL COMPENSATION METHOD

FIELD OF THE INVENTION

The present invention relates to display field, and more particularly to an OLED pixel compensation circuit and an OLED pixel compensation method.

BACKGROUND

In an Organic Light Emitting Diode (OLED) display panel, the electrical characteristic of each driving transistor has a certain difference due to the manufacturing limitation. Further, when a driving transistor is working, the characteristic of the driving transistor may vary due to the influences of ambient temperature or lights. The difference between different driving transistors and the variance occurred when a driving transistor is working will make the display panel unstable and thus outputs an uneven luminance.

SUMMARY

One objective of an embodiment of the present invention is to provide an OLED pixel compensation circuit and OLED pixel compensation method to solve the above-mentioned luminance unevenness of the display panel.

According to an embodiment of the present invention, an OLED pixel compensation circuit is provided. The OLED pixel compensation circuit comprises: an OLED, having an anode connected to a third node and a cathode connected to a low voltage level line; a driving transistor, which is a double gate TFT (thin film transistor), configured to drive the OLED, the driving transistor having a top gate coupled to a first node, a bottom gate coupled to a second node, a source coupled to the third node, and a drain coupled to a high voltage level line; a first TFT, having a gate connected to a first control signal line, a first end connected to a data line, and a second end connected to the second node; a second TFT, having a gate connected to a second control signal line, a first end connected to the data line, and a second end connected to the third node; a third TFT, having a gate connected to a third control signal line, a first end connected to a constant voltage source via a first switch, and a second end connected to the first node; a fourth TFT, having a gate connected to a fourth control signal line, a first end connected to the constant voltage source, and a second end connected to the third node; a first capacitor, connected between the second node and the third node; and a second capacitor, connected between the first node and the third node.

According to an embodiment of the present invention, an OLED pixel compensation method is provided. The OLED pixel compensation method comprises: providing the OLED pixel compensation circuit; entering an initiation phase; in the initiation phase, the first control signal line, the third control signal line, and the fourth control signal line correspond to a high voltage level such that the first TFT, the third TFT and the fourth TFT are turned on, the second control signal line corresponds to a low voltage level such that the second TFT is turned off, the data line provides a predetermined voltage level such that the predetermined voltage level is written into the second node, the first switch is closed such that a voltage of the constant voltage source is written into the first node; entering a detection phase; in the detection phase, the first control signal line and the third control signal line correspond to the high voltage level such that the first TFT and the third TFT are turned on, the second control signal line and the fourth control signal line correspond to the low voltage level such that the second TFT and the fourth TFT are turned off, the first switch is closed, the data line provides the predetermined voltage, the driving transistor is turned on, a voltage of the third node increases as time goes by, a voltage difference between the source and the drain of the driving transistor decreases, when the voltage difference is equal to a threshold voltage of the driving transistor, the driving transistor cuts off, at this time, the threshold voltage is stored in the first capacitor; entering a threshold voltage storage phase; in the threshold voltage storage phase, the first control signal line and the second control signal line correspond to the high voltage level such that the first TFT and the second TFT are turned on, the third control signal line and the fourth control signal line correspond to the low voltage level such that the third TFT and the fourth TFT are turned off, the switch control signal is open, the data line provides the predetermined voltage level, the voltage of the source of the driving transistor is the predetermined voltage level, at this time, the threshold voltage of the driving transistor is stored in the second capacitor; entering a data written phase; in the data written phase, the first control signal line corresponds to the high voltage level such that the first TFT is turned on, the second control signal line, the third control signal line and the fourth control signal line correspond to the low voltage level such that the second TFT, the third TFT and the fourth TFT are turned off, the first switch is open, the data line provides a data signal high voltage level, and the data signal high voltage level is written into the second node; entering a lighting phase; and in the lighting phase, the first control signal line, the second control signal line, the third signal line and the fourth control signal line all correspond to the low voltage level such that the first TFT, the second TFT, the third TFT, and the fourth TFT are turned off, the first switch is open, the driving transistor is turned on and the OLED is lightened.

In contrast to the conventional art, an objective of an embodiment of the present invention provides an OLED pixel compensation circuit and an OLED pixel compensation method, which adopts 5T2C structure and the driving transistor is a double gate TFT to compensate the variance of the threshold voltage such that the luminance evenness is raised and the lifetime of the product is extended.

BRIEF DESCRIPTION OF THE DRAWINGS

The accompanying drawings described herein are used to provide further comprehension of the present disclosure, and is a part of the present application. Schematic embodiments of the present disclosure and the description thereof are used to illustrate the present disclosure, but do not constitute any improper limit to the present disclosure. In the accompanying drawings.

DETAILED DESCRIPTION OF PREFERRED EMBODIMENTS

Figure 1:
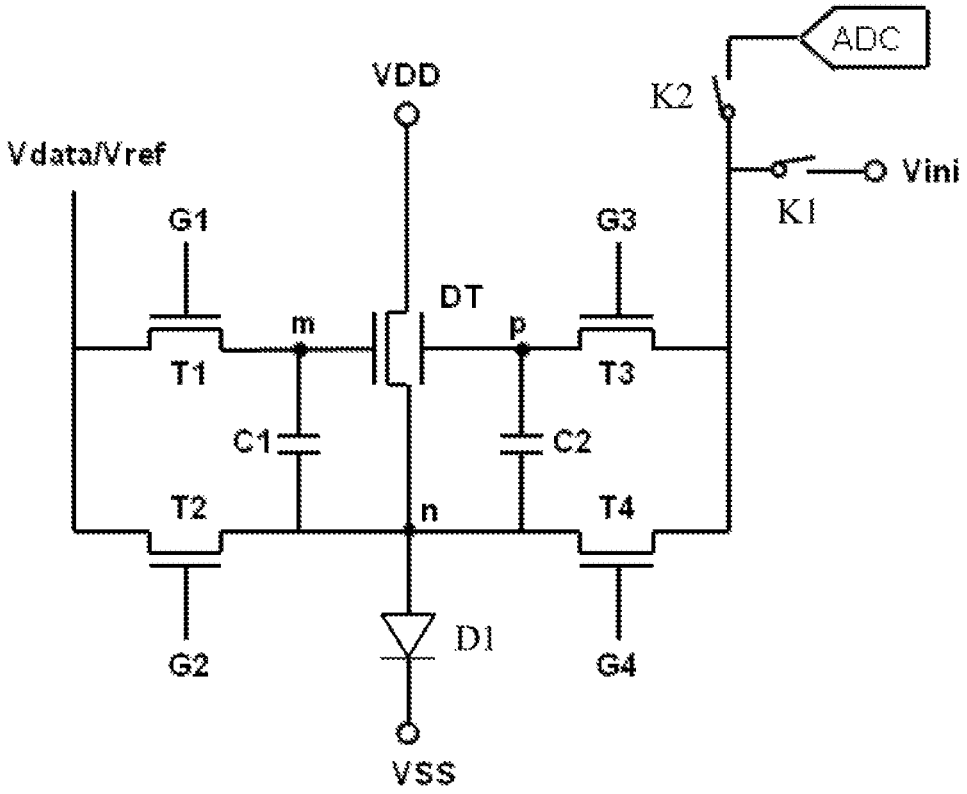
FIG. 1 is a diagram of an OLED pixel compensation circuit according to an embodiment of the present invention.

The invention is described below in detail with reference to the accompanying drawings, wherein like reference numerals are used to identify like elements illustrated in one or more of the figures thereof, and in which exemplary embodiments of the invention are shown. This invention may, however, be embodied in many different forms and should not be construed as limited to the particular embodiments set forth herein. Rather, these embodiments are provided so that this disclosure will be thorough and complete, and will fully convey the scope of the invention to those skilled in the art.

Please refer to FIG. 1, which is a diagram of an OLED pixel compensation circuit according to an embodiment of the present invention. The OLED pixel compensation circuit comprises an OLED D1, a driving transistor DT, a first TFT T1, a second TFT T2, a third TFT T3, a fourth TFT T4, a first capacitor C1 and a second capacitor C2. The anode of the OLED D1 is connected to a third node n and the cathode of the OLDE D1 is connected to a low voltage level line VSS. The driving transistor DT is a double gate TFT, which is used to drive the OLED D1. The top gate of the driving transistor DT is coupled to a first node p and the bottom gate of the driving transistor DT is coupled to a second node m. The source of the driving transistor DT is connected to the third node n and the drain of the driving transistor DT is connected to a high voltage level line VDD. The gate of the first TFT T1 is connected to the first control signal line G1, the first end of the first TFT T1 is connected to the data line and the second end of the first TFT T1 is connected to the second node m. The gate of the second transistor T2 is connected to the second control signal line G2, the first end of the second transistor T2 is connected to the data line and the second end of the second transistor T2 is connected to the third node n. The gate of the third transistor T3 is connected to the third control signal line G3, the first end of the third transistor T3 is connected to a constant voltage source Vini via a first switch K1, and the second end of the third transistor T3 is connected to the first node p. The gate of the fourth transistor T4 is connected to the fourth control signal line G4, the first end of the fourth transistor T4 is connected to the constant voltage source Vini via a first switch K1, and the second end of the fourth transistor T4 is connected to the third node n. The first capacitor C1 is connected between the second node m and the third node n. The second capacitor C2 is connected between the first node p and the third node n.

In this embodiment, the high voltage level line VDD corresponds to 20 V and the low voltage level line VSS corresponds to −5V. These numbers are not limitations of this application. They could be changed according to different design demands.

In this embodiment, 5T2C (five transistors and 2 capacitors) structure is used and the driving transistor DT is a double gate TFT, which works as the inner driving circuit to increase the top gate voltage of the driving transistor DT in order to compensate the variance of the threshold voltage of the driving transistor DT. This increases the luminance evenness of the display panel and improves the lifetime of the product.

Figure 2:
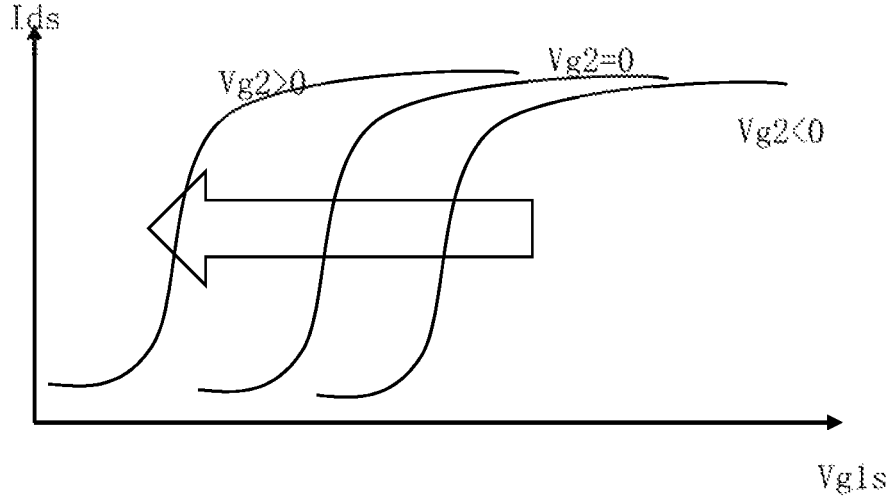
FIG. 2 shows the working theory of the driving transistor shown in FIG. 1.

Please refer to FIG. 2, which shows the working theory of the driving transistor shown in FIG. 1. When the voltage Vg2 applied on the top gate of the driving transistor DT gradually increases, the current characteristic curve and the voltage difference between the gate and the source of the driving transistor DT proportionally decreases. That is, the voltage difference between the gate and the source of the driving transistor DT and the top gate voltage are in a negative coherence. The top gate voltage is higher, the lower the he voltage difference between the gate and the source of the driving transistor DT is. Therefore, in this embodiment, the top gate voltage of the driving transistor DT is increased to compensate the threshold voltage of the driving transistor DT.

In this embodiment, the first TFT T1, the second TFT T2, the third TFT T3, and the fourth TFT T4 could all be N-type transistors or P-type transistors. This is not a limitation of the present invention.

The signals of the first control signal line G1, the second control signal line G2, the third control signal line G3 and the fourth control signal line G4 and the switch control signal of the first switch K1 are provide by an external timing controller.

Figure 3:
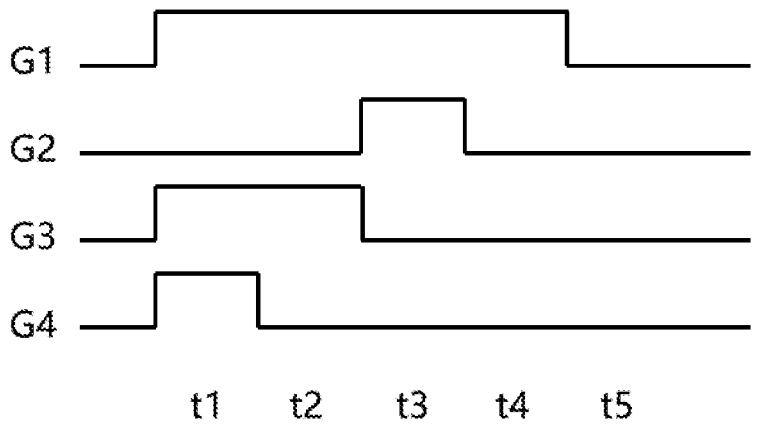
FIG. 3 is a diagram showing the timings of OLED pixel compensation circuit according to an embodiment of the present invention.

Please refer to FIG. 3. FIG. 3 is a diagram showing the timings of OLED pixel compensation circuit according to an embodiment of the present invention. The signals of the first control signal line G1, the second control signal line G2, the third control signal line G3 and the fourth control signal line G4 and the switch control signal of the first switch K1 are in different combinations such that the OLED pixel compensation circuit could sequentially enter an initiation phase, a detection phase, a threshold voltage storage phase, a data written phase, and a lighting phase.

In the initiation phase, the first control signal line G1, the third control signal line G3, and the fourth control signal line G4 correspond to a high voltage level, the second control signal line G2 corresponds to a low voltage level, and the switch control signal of the first switch K1 corresponds to a close signal. In the detection phase, the first control signal line G1 and the third control signal line G3 correspond to the high voltage level, the second control signal line G2 and the fourth control signal line G4 correspond to the low voltage level, and the switch control signal of the first switch K1 corresponds to the close signal. In the threshold voltage storage phase, the first control signal line G1 and the second control signal line G2 correspond to the high voltage level, the third control signal line G3 and the fourth control signal line G4 correspond to the low voltage level, and the switch control signal of the first switch K1 corresponds to a open signal. In the data written phase, the first control signal line G1 corresponds to the high voltage level, the second control signal line G2, the third control signal line G3 and the fourth control signal line G4 correspond to the low voltage level, and the switch control signal of the first switch K1 corresponds to the open signal. In the lighting phase, the first control signal line G1, the second control signal line G2, the third signal line G3 and the fourth signal line G4 all correspond to the low voltage level, and the switch control signal of the first switch K1 corresponds to the open signal.

Preferably, in this embodiment, as shown in FIG. 1, the OLED pixel compensation circuit further comprises an external detection circuit. The external detection circuit is parallel connected to the constant voltage source Vini and the first switch K1 via the second switch K2.

Please refer FIG. 1 in conjunction with FIG. 3. The working flow of the OLED compensation circuit is as follows:

In the initiation phase, the first control signal line G1, the third control signal line G3, and the fourth control signal line G4 correspond to a high voltage level such that the first TFT T1, the third TFT T3 and the fourth TFT T4 are turned on. The second control signal line G2 corresponds to a low voltage level such that the second TFT T2 is turned off. The data line provides a predetermined voltage level Vref such that the predetermined voltage level vref is written into the second node m. The switch control signal of the first switch K1 corresponds to a close signal such that the first switch K1 is closed. The voltage Vini of the constant voltage source is written into the first node p and the third node n. In this embodiment, the voltage Vini of the constant voltage source is lower than the threshold voltage $V_{OLED}$ of the OLED D1 and $V_{ref}-V_{ini}>V_{th\text{-}TFT}$. Please note, $V_{th\text{-}TFT}$ represents the threshold voltage of the driving transistor DT. Therefore, in the initiation phase, the OLED does not generate lights.

In the detection phase, the first control signal line G1 and the third control signal line G3 correspond to the high voltage level such that the first TFT T1 and the third TFT T3 are turned on. The second control signal line G2 and the fourth control signal line G4 correspond to the low voltage level such that the second TFT T2 and the fourth TFT T4 are turned off. The data line provides the predetermined voltage Vref. The predetermined voltage Vref is written into the second node m. The switch control signal of the first switch K1 corresponds to a close signal such that the first switch K1 is closed. The voltage Vini is written into the first node p. Because $V_{ref}>V_{ini}>V_{th\text{-}TFT}$, the driving transistor DT is conductive. A voltage of the third node n increases as time goes by, and a voltage difference between the source and the drain of the driving transistor decreases. When the voltage difference is equal to $V_{th\text{-}TFT}$, the driving transistor cuts off. At this time, the voltage of the third node is $V_{ref}-V_{th\text{-}TFT}$. The threshold voltage $V_{th\text{-}TFT}$ of the driving transistor DT is stored in the first capacitor C1 and the voltage difference between the first node p and the third node n is $V_{ini}-(V_{ref}-V_{th\text{-}TFT})$.

In the threshold voltage storage phase, the first control signal line G1 and the second control signal line G2 correspond to the high voltage level such that the first TFT T1 and the second TFT T2 are turned on. The third control signal line G3 and the fourth control signal line G4 correspond to the low voltage level such that the third TFT T3 and the fourth TFT T4 are turned off. The data line provides the predetermined voltage level Vref. The predetermined voltage level Vref is written into the second node m and the third node n. The switch control signal of the first switch K1 corresponds to an open signal such that the first switch K1 is open. Because the voltage difference between the first node p and the third node n is $V_{ini}-(V_{ref}-V_{th\text{-}TFT})$ in the detection phase, the voltage of the third node n is Vref at this time. According to the capacitor coupling effect, the voltage of the first node p is $V_{ini}+V_{th\text{-}TFT}$ and the threshold voltage $V_{th\text{-}TFT}$ of the driving transistor DT is stored in the second capacitor C2.

In the data written phase, the first control signal line G1 corresponds to the high voltage level such that the first TFT T1 is turned on, the second control signal line G2, the third control signal line G3 and the fourth control signal line G4 correspond to the low voltage level such that the second TFT T2, the third TFT T3 and the fourth TFT T4 are turned off. The data line provides a data signal high voltage level Vdata and the data signal high voltage level Vdata is written into the second node m. The switch control signal of the first switch K1 corresponds to an open signal such that the first switch K1 is open.

In the lighting phase, the first control signal line G1, the second control signal line G2, the third signal line G3 and the fourth control signal line G4 all correspond to the low voltage level such that the first TFT T1, the second TFT T2, the third TFT G3, and the fourth TFT G4 are turned off. The switch control signal of the first switch K1 corresponds to the open signal such that the first switch K1 is open. The driving transistor DT is turned on such that the OLED D1 generates lights.

Figure 4:
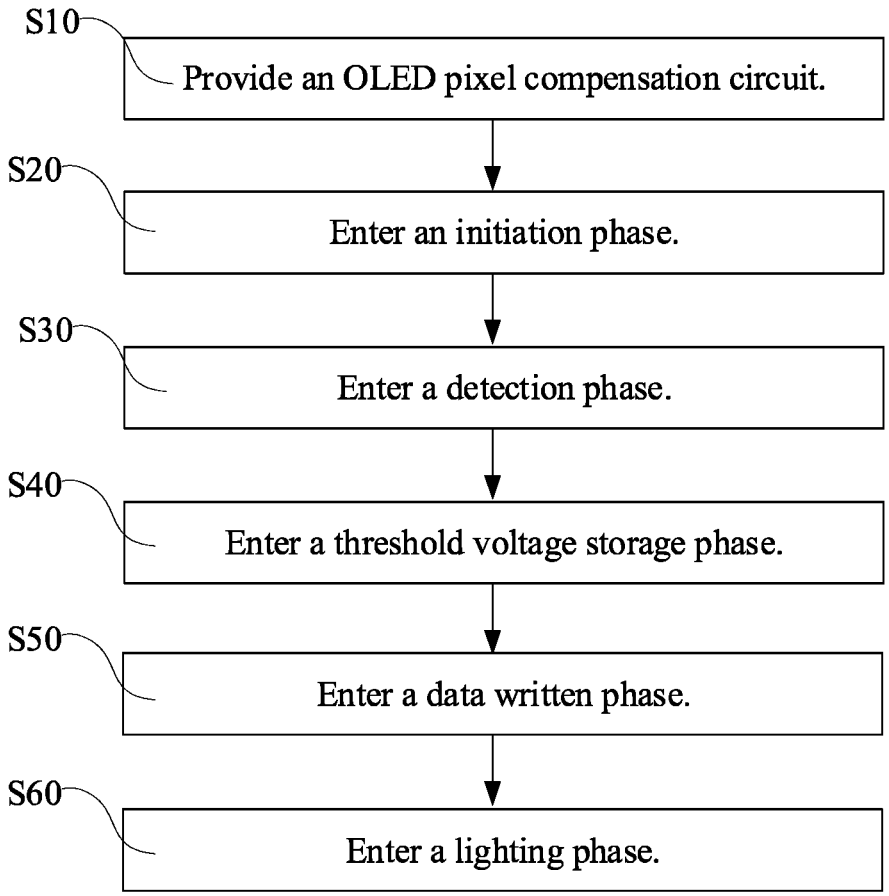
FIG. 4 is a flow chart of an OLED pixel compensation method according to an embodiment of the present invention.

According to an embodiment of the present invention, an OLED pixel compensation method is provided. Please refer to FIG. 4, which is a flow chart of an OLED pixel compensation method according to an embodiment of the present invention. The OLED pixel compensation method comprises the following steps:

S10: Providing the OLED pixel compensation circuit.

The OLED pixel compensation circuit comprises an OLED D1, a driving transistor DT, a first TFT T1, a second TFT T2, a third TFT T3, a fourth TFT T4, a first capacitor C1 and a second capacitor C2. The anode of the OLED D1 is connected to a third node n and the cathode of the OLDE D1 is connected to a low voltage level line VSS. The driving transistor DT is a double gate TFT, which is used to drive the OLED D1. The top gate of the driving transistor DT is coupled to a first node p and the bottom gate of the driving transistor DT is coupled to a second node m. The source of the driving transistor DT is connected to the third node n and the drain of the driving transistor DT is connected to a high voltage level line VDD. The gate of the first TFT T1 is connected to the first control signal line G1, the first end of the first TFT T1 is connected to the data line and the second end of the first TFT T1 is connected to the second node m. The gate of the second transistor T2 is connected to the second control signal line G2, the first end of the second transistor T2 is connected to the data line and the second end of the second transistor T2 is connected to the third node n. The gate of the third transistor T3 is connected to the third control signal line G3, the first end of the third transistor T3 is connected to a constant voltage source Vini via a first switch K1, and the second end of the third transistor T3 is connected to the first node p. The gate of the fourth transistor T4 is connected to the fourth control signal line G4, the first end of the fourth transistor T4 is connected to the constant voltage source Vini via a first switch K1, and the second end of the fourth transistor T4 is connected to the third node n. The first capacitor C1 is connected between the second node m and the third node n. The second capacitor C2 is connected between the first node p and the third node n.

Figure 5:
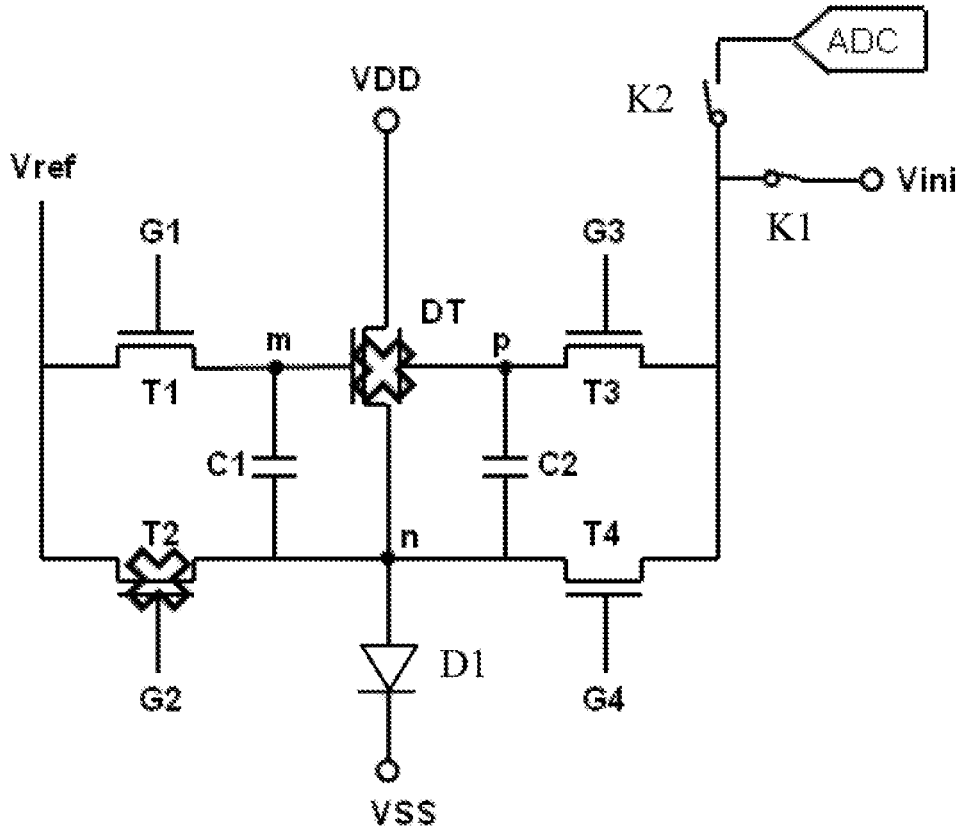
FIG. 5 is a diagram showing the circuit when the OLED pixel compensation circuit is in an initiation phase according to an embodiment of the present invention.

S20: Entering an initiation phase. Please refer to FIG. 3 in conjunction with FIG. 5. FIG. 5 is a diagram showing the circuit when the OLED pixel compensation circuit is in an initiation phase according to an embodiment of the present invention. the first control signal line G1, the third control signal line G3, and the fourth control signal line G4 correspond to a high voltage level such that the first TFT T1, the third TFT T3 and the fourth TFT T4 are turned on. The second control signal line G2 corresponds to a low voltage level such that the second TFT T2 is turned off. The data line provides a predetermined voltage level Vref such that the predetermined voltage level vref is written into the second node m. The switch control signal of the first switch K1 corresponds to a close signal such that the first switch K1 is closed. The voltage Vini of the constant voltage source is written into the first node p and the third node n. In this embodiment, the voltage Vini of the constant voltage source is lower than the threshold voltage $V_{OLED}$ of the OLED D1 and $V_{ref}-V_{ini}>V_{th\text{-}TFT}$. Please note, $V_{th\text{-}TFT}$ represents the threshold voltage of the driving transistor DT. Therefore, in the initiation phase, the OLED does not generate lights.

Figure 6:
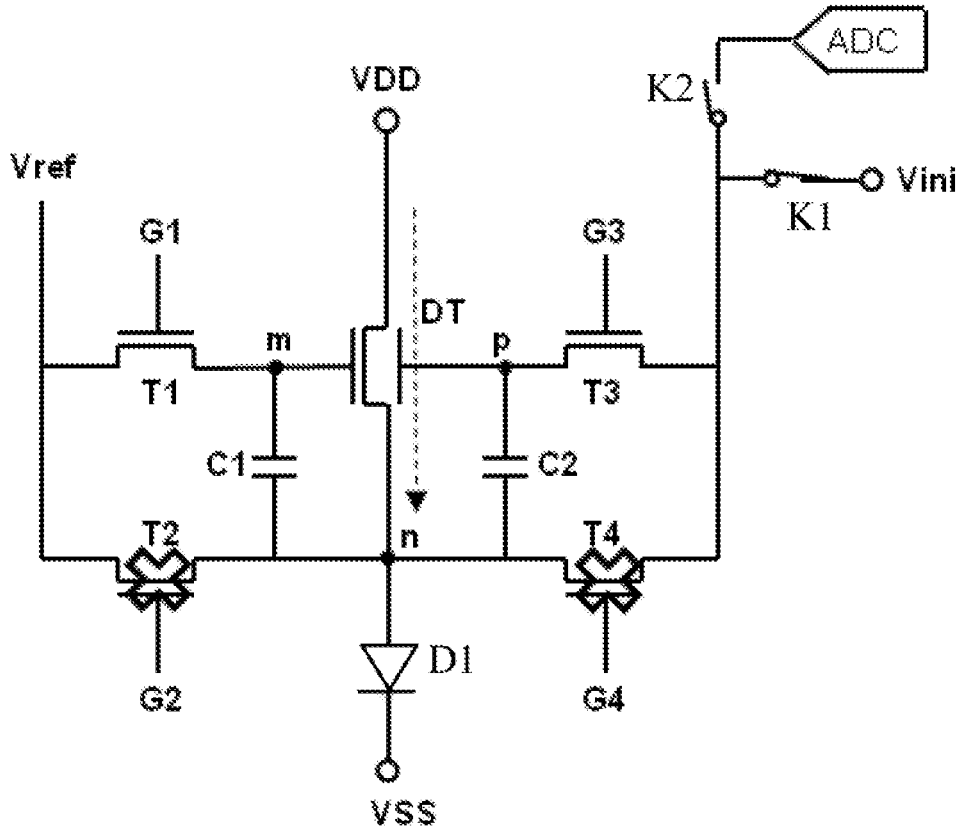
FIG. 6 is a diagram showing the circuit when the OLED pixel compensation circuit is in a detection phase according to an embodiment of the present invention.

S30: Entering the detection phase. Please refer to FIG. 3 in conjunction with FIG. 6. FIG. 6 is a diagram showing the circuit when the OLED pixel compensation circuit is in a detection phase according to an embodiment of the present invention. In the detection phase, the first control signal line G1 and the third control signal line G3 correspond to the high voltage level such that the first TFT T1 and the third TFT T3 are turned on. The second control signal line G2 and the fourth control signal line G4 correspond to the low voltage level such that the second TFT T2 and the fourth TFT T4 are turned off. The data line provides the predetermined voltage Vref. The predetermined voltage Vref is written into the second node m. The switch control signal of the first switch K1 corresponds to a close signal such that the first switch K1 is closed. The voltage Vini is written into the first node p. Because $V_{ref}-V_{ini}>V_{th\text{-}TFT}$, the driving transistor DT is conductive. A voltage of the third node n increases as time goes by, and a voltage difference between the source and the drain of the driving transistor decreases. When the voltage difference is equal to $V_{th\text{-}TFT}$, the driving transistor cuts off. At this time, the voltage of the third node is $V_{ref}-V_{th\text{-}TFT}$. The threshold voltage $V_{th\text{-}TFT}$ of the driving transistor DT is stored in the first capacitor C1 and the voltage difference between the first node p and the third node n is $V_{ini}-(V_{ref}-V_{th\text{-}TFT})$.

Figure 7:
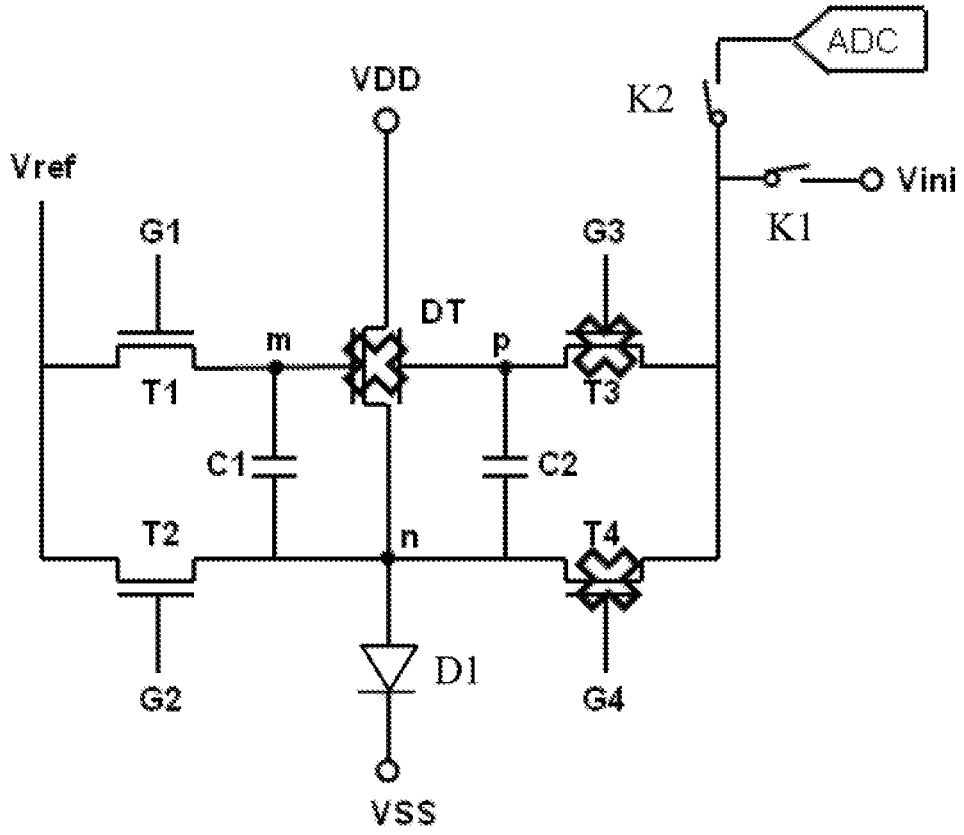
FIG. 7 is a diagram showing the circuit when the OLED pixel compensation circuit is in a threshold voltage storage phase according to an embodiment of the present invention.

S40: Entering the threshold voltage storage phase. Please refer to FIG. 3 in conjunction with FIG. 7. FIG. 7 is a diagram showing the circuit when the OLED pixel compensation circuit is in a threshold voltage storage phase according to an embodiment of the present invention. In the threshold voltage storage phase, the first control signal line G1 and the second control signal line G2 correspond to the high voltage level such that the first TFT T1 and the second TFT T2 are turned on. The third control signal line G3 and the fourth control signal line G4 correspond to the low voltage level such that the third TFT T3 and the fourth TFT T4 are turned off. The data line provides the predetermined voltage level Vref. The predetermined voltage level Vref is written into the second node m and the third node n. The switch control signal of the first switch K1 corresponds to an open signal such that the first switch K1 is open. Because the voltage difference between the first node p and the third node n is $V_{ini}-(V_{ref}-V_{th\text{-}TFT})$ in the detection phase, the voltage of the third node n is Vref at this time. According to the capacitor coupling effect, the voltage of the first node p is $V_{ini}+V_{th\text{-}TFT}$ and the threshold voltage $V_{th\text{-}TFT}$ of the driving transistor DT is stored in the second capacitor C2.

Figure 8:
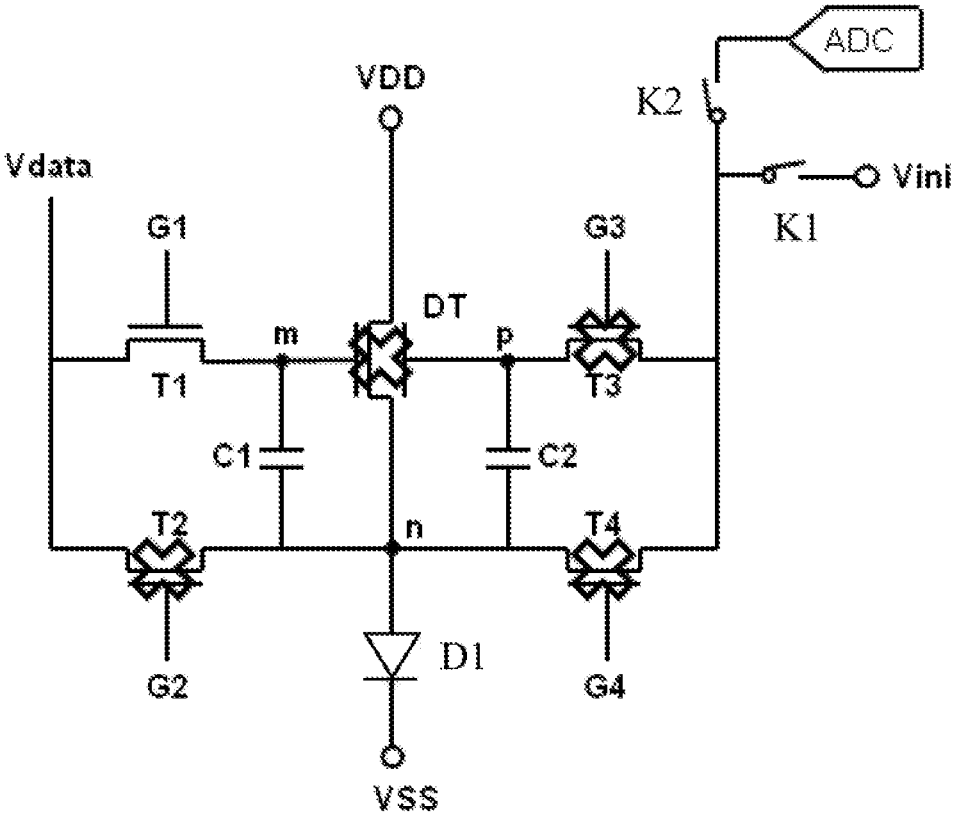
FIG. 8 is a diagram showing the circuit when the OLED pixel compensation circuit is in a data written phase according to an embodiment of the present invention.

S50: Entering the data written phase. Please refer to FIG. 3 in conjunction with FIG. 8. FIG. 8 is a diagram showing the circuit when the OLED pixel compensation circuit is in a data written phase according to an embodiment of the present invention. In the data written phase, the first control signal line G1 corresponds to the high voltage level such that the first TFT T1 is turned on, the second control signal line G2, the third control signal line G3 and the fourth control signal line G4 correspond to the low voltage level such that the second TFT T2, the third TFT T3 and the fourth TFT T4 are turned off. The data line provides a data signal high voltage level Vdata and the data signal high voltage level Vdata is written into the second node m. The switch control signal of the first switch K1 corresponds to an open signal such that the first switch K1 is open.

Figure 9:
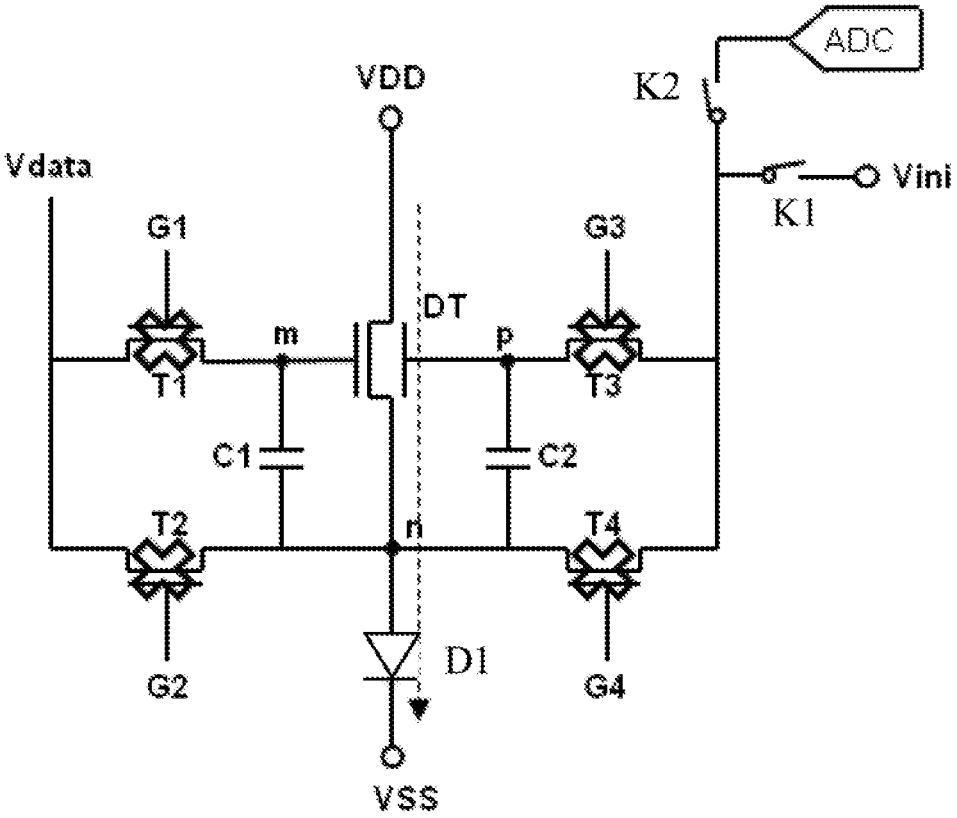
FIG. 9 is a diagram showing the circuit when the OLED pixel compensation circuit is in a lighting phase according to an embodiment of the present invention.

S60: Entering the data written phase. Please refer to FIG. 3 in conjunction with FIG. 9. FIG. 9 is a diagram showing the circuit when the OLED pixel compensation circuit is in a lighting phase according to an embodiment of the present invention. In the lighting phase, the first control signal line G1, the second control signal line G2, the third signal line G3 and the fourth control signal line G4 all correspond to the low voltage level such that the first TFT T1, the second TFT T2, the third TFT G3, and the fourth TFT G4 are turned off. The switch control signal of the first switch K1 corresponds to the open signal such that the first switch K1 is open. The driving transistor DT is turned on such that the OLED D1 generates lights.

In this embodiment, the signals of the first control signal line G1, the second control signal line G2, the third control signal line G3 and the fourth control signal line G4 and the switch control signal of the first switch K1 are provide by an external timing controller. However, this is not a limitation of the present invention.

Furthermore, in this embodiment, the OLED pixel compensation circuit further comprises an external detection circuit. The external detection circuit is parallel connected to the constant voltage source Vini and the first switch K1 via the second switch K2. The external detection circuit is used to input an external compensation signal. The external detection circuit is used when an external compensation is required. The external detection circuit could be set in an driving IC (integrated circuit) or a driving system to assist an inner compensation circuit to perform a threshold voltage compensation.

From the above, it could be seen that 5T2C (five transistors and 2 capacitors) structure is used and the driving transistor DT is a double gate TFT, which works as the inner driving circuit to increase the top gate voltage of the driving transistor DT in order to compensate the variance of the threshold voltage of the driving transistor DT. This increases the luminance evenness of the display panel and improves the lifetime of the product.

Above are embodiments of the present invention, which does not limit the scope of the present invention. Any modifications, equivalent replacements or improvements within the spirit and principles of the embodiment described above should be covered by the protected scope of the invention.

What is claimed is:

1. An Organic Light Emitting Diode (OLED) pixel compensation circuit, comprising:

an OLED, having an anode connected to a third node and a cathode connected to a low voltage level line;

a driving transistor, which is a double gate thin film transistor (TFT), configured to drive the OLED, the driving transistor having a top gate coupled to a first node, a bottom gate coupled to a second node, a source coupled to the third node, and a drain coupled to a high voltage level line;

a first TFT, having a gate connected to a first control signal line, a first end connected to a data line, and a second end connected to the second node;

a second TFT, having a gate connected to a second control signal line, a first end connected to the data line, and a second end connected to the third node;

a third TFT, having a gate connected to a third control signal line, a first end connected to a constant voltage source via a first switch, and a second end connected to the first node;

a fourth TFT, having a gate connected to a fourth control signal line, a first end connected to the constant voltage source, and a second end connected to the third node;

a first capacitor, connected between the second node and the third node; and a second capacitor, connected between the first node and the third node, wherein signals of the first control signal line, the second control signal line, the third control signal line, the fourth control signal line and a switch control signal of the first switch are provided by an external timing controller, wherein the signals of the first control signal line, the second control signal line, the third control signal line, the fourth control signal line and the switch control signal of the first switch are arranged as follows:

the OLED pixel compensation circuit sequentially enters an initiation phase, a detection phase, a threshold voltage storage phase, a data written phase, and a lighting phase;

in the initiation phase, the first control signal line, the third control signal line, and the fourth control signal line correspond to a high voltage level, the second control signal line corresponds to a low voltage level, and the switch control signal of the first switch corresponds to a close signal;

in the detection phase, the first control signal line and the third control signal line correspond to the high voltage level, the second control signal line and the fourth control signal line correspond to the low voltage level, and the switch control signal of the first switch corresponds to the close signal;

in the threshold voltage storage phase, the first control signal line and the second control signal line correspond to the high voltage level, the third control signal line and the fourth control signal line correspond to the low voltage level, and the switch control signal of the first switch corresponds to an open signal;

in the data written phase, the first control signal line corresponds to the high voltage level, the second control signal line, the third control signal line and the fourth control signal line correspond to the low voltage level, and the switch control signal of the first switch corresponds to the open signal; and in the lighting phase, the first control signal line, the second control signal line, the third signal line and the fourth signal line all correspond to the low voltage level, and the switch control signal of the first switch corresponds to the open signal.

2. The OLED pixel compensation circuit of claim 1, wherein when a voltage applied to the top gate of the driving transistor increases, a voltage difference between the drain and the source of the driving transistor and the current characteristic curve of the driving transistor proportionally decreases according to the voltage.

3. The OLED pixel compensation circuit of claim 1, wherein the first TFT, the second TFT, the third TFT and the fourth TFT are all N-type transistors or P-type transistors.

4. The OLED pixel compensation circuit of claim 1, wherein the OLED pixel compensation circuit further comprises an external detection circuit, parallel connected to the constant voltage source and the first switch via a second switch.

5. An Organic Light Emitting Diode (OLED) pixel compensation method comprising:

providing an OLED pixel compensation circuit, wherein the OLED pixel compensation circuit comprises:

a driving transistor, which is a double gate thin film transistor (TFT), configured to drive the OLED, the driving transistor having a top gate coupled to a first node, a bottom gate coupled to a second node, a source coupled to a third node, and a drain coupled to a high voltage level line;

a first TFT, having a gate connected to a first control signal line, a first end connected to a data line, and a second end connected to the second node;

a second TFT, having a gate connected to a second control signal line, a first end connected to the data line, and a second end connected to the third node;

a third TFT, having a gate connected to a third control signal line, a first end connected to a constant voltage source via a first switch, and a second end connected to the first node;

a fourth TFT, having a gate connected to a fourth control signal line, a first end connected to the constant voltage source, and a second end connected to the third node;

a first capacitor, connected between the second node and the third node; and a second capacitor, connected between the first node and the third node;

an OLED, having an anode connected to the third node and a cathode connected to a low voltage level line;

entering an initiation phase, wherein in the initiation phase, the first control signal line, the third control signal line, and the fourth control signal line correspond to a high voltage level such that the first TFT, the third TFT and the fourth TFT are turned on, the second control signal line corresponds to a low voltage level such that the second TFT is turned off, the data line provides a predetermined voltage level such that the predetermined voltage level is written into the second node, the first switch is closed such that a voltage of the constant voltage source is written into the first node;

entering a detection phase, wherein in the detection phase, the first control signal line and the third control signal line correspond to the high voltage level such that the first TFT and the third TFT are turned on, the second control signal line and the fourth control signal line correspond to the low voltage level such that the second TFT and the fourth TFT are turned off, the first switch is closed, the data line provides the predetermined voltage, the driving transistor is turned on, a voltage of the third node increases as time goes by, a voltage difference between the source and the drain of the driving transistor decreases, when the voltage difference is equal to a threshold voltage of the driving transistor, the driving transistor cuts off, at this time, the threshold voltage is stored in the first capacitor;

entering a threshold voltage storage phase, wherein in the threshold voltage storage phase, the first control signal line and the second control signal line correspond to the high voltage level such that the first TFT and the second TFT are turned on, the third control signal line and the fourth control signal line correspond to the low voltage level such that the third TFT and the fourth TFT are turned off, the first switch is open, the data line provides the predetermined voltage level, the voltage of the source of the driving transistor is the predetermined voltage level, at this time, the threshold voltage of the driving transistor is stored in the second capacitor;

entering a data written phase, wherein in the data written phase, the first control signal line corresponds to the high voltage level such that the first TFT is turned on, the second control signal line, the third control signal line and the fourth control signal line correspond to the low voltage level such that the second TFT, the third TFT and the fourth TFT are turned off, the first switch is open, the data line provides a data signal high voltage level, and the data signal high voltage level is written into the second node; and entering a lighting phase, wherein in the lighting phase, the first control signal line, the second control signal line, the third signal line and the fourth control signal line all correspond to the low voltage level such that the first TFT, the second TFT, the third TFT, and the fourth TFT are turned off, the first switch is open, the driving transistor is turned on and the OLED generates lights.

6. The OLED pixel compensation method of claim 5, wherein the voltage of the constant voltage source is lower than a threshold voltage of the OLED and a difference between the predetermined voltage level and the voltage of the constant voltage source is larger than the threshold voltage of the driving transistor.

7. The OLED pixel compensation method of claim 5, wherein signals of the first control signal line, the second control signal line, the third control signal line, the fourth control signal line and a switch control signal of the first switch are provided by an external timing controller.

8. The OLED pixel compensation method of claim 5, wherein the pixel compensation circuit further comprises an external detection circuit, parallel connected to the constant voltage source and the first switch via a second switch, configured to output an external compensation signal.

* * * * *